US006000246A

United States Patent [19]

Hsieh et al.

[11] Patent Number: 6,000,246

[45] Date of Patent: Dec. 14, 1999

[54] STEPLESS SPEED CHANGE TYPE CLOTH TAKE-UP DEVICE FOR A CIRCULAR KNITTING MACHINE

[76] Inventors: Wen-Bin Hsieh, No. 2, Lane 281, Fu-Te 1st Rd., Hsichih Town, Taipei County; Kuo-Hsin Su, 2F., No. 4, Lane 220, Sec. 3, Chung-Hsing Rd., Hsin-Tien City, Taipei County, both of Taiwan

[21] Appl. No.: 09/088,877

[22] Filed: Jun. 2, 1998

[51] Int. Cl.[6] ..... D04B 15/88

[52] U.S. Cl. ..... 66/151; 66/153; 242/415

[58] Field of Search ..... 66/153, 151; 242/415

[56] References Cited

U.S. PATENT DOCUMENTS 4,879,886 11/1989 Okada et al. ..... 66/151
5,457,967 10/1995 Scherzinger ..... 66/151

FOREIGN PATENT DOCUMENTS 4-289251 10/1992 Japan ..... 66/153

*Primary Examiner*—Andy Falik
*Attorney, Agent, or Firm*—Rosenberg, Klein & Lee

[57] ABSTRACT

A cloth take-up device for a circular knitting machine includes first and second vertical side panels, a cloth-transfer cylinder connected between the vertical side panels adjacent a top side of the vertical side panels, and two impression cylinders connected in parallel between the vertical side panels and peripherally disposed in contact with the cloth-transfer cylinder at two opposite sides for guiding a finished piece of knitted fabric over the cloth-transfer cylinder. Two parallel support arms are respectively pivoted to the vertical side panels. A cloth take-up cylinder is connected between the support arms. A transmission shaft is coupled to a main bevel gear by an auxiliary bevel gear. A gear train is coupled to the main bevel gear by another auxiliary bevel gear, and a belt transmission mechanism is mounted on the second vertical side panel. The belt transmission mechanism is driven by the transmission shaft to rotate the cloth take-up cylinder, causing it to take up the finished piece of knitted fabric. A stepless speed change device is provided having an input shaft coupled to the gear train. A chain transmission mechanism is mounted on the first vertical side panel and is driven by the output shaft of the stepless speed change device to rotate the cloth-transfer cylinder, enabling the finished piece of knitted fabric to be carried forwards by the cloth-transfer cylinder and taken up by the cloth take-up cylinder.

5 Claims, 9 Drawing Sheets

STEPLESS SPEED CHANGE TYPE CLOTH TAKE-UP DEVICE FOR A CIRCULAR KNITTING MACHINE

BACKGROUND OF THE INVENTION

The present invention relates to a cloth take-up device for use with a circular knitting machine to automatically take up the knitted fabric, and more particularly to a stepless speed change type cloth take-up device which automatically changes the cloth taking up speed subject to the feeding speed of the finished knitted fabric.

Conventional cloth take-up devices which are designed for use with a circular knitting machine to automatically take up the knitted fabric commonly use a multi-step speed change device to control the revolving speed of the cloth take-up cylinder subject to the feeding speed of the finished piece of knitted fabric. Because the multi-step speed change device is not a stepless speed change mechanism, it cannot fit the feeding speed of the finished piece of knitted fabric perfectly. A minor speed difference between the feeding speed of the finished piece of knitted fabric and the cloth take-up cylinder may cause the finished piece of knitted fabric or parts of the circular knitting machine to be damaged. Furthermore, conventional cloth take-up devices are designed to fit a particular model of circular knitting machine, i.e., one particular cloth take-up device must be used with one particular model of circular knitting machine.

SUMMARY OF THE INVENTION

The present invention has been accomplished to provide a cloth take-up device which eliminates the aforesaid drawbacks. It is one object of the present invention to provide a cloth take-up device which uses a stepless speed change device to control the cloth taking up speed subject to the feeding speed of the finished piece of knitted fabric. It is another object of the present invention to provide a cloth take-up device which fits any of a variety of circular knitting machines. According to one aspect of the present invention, the cloth take-up device uses a belt transmission mechanism to rotate a cloth take-up cylinder, a chain transmission mechanism to rotate a cloth-transfer cylinder, and a stepless speed change device which controls the revolving speed of the chain transmission mechanism to fit the feeding speed of the finished knitted fabric. According to another aspect of the present invention, a tension detecting wheel is provided to detect the tension of the chain of the chain transmission mechanism, and to control the revolving speed of the output shaft of the stepless speed change device subject to the tension of the chain of the chain transmission mechanism.

DETAILED DESCRIPTION OF THE PREFERRED EMBODIMENT

Figure 1:
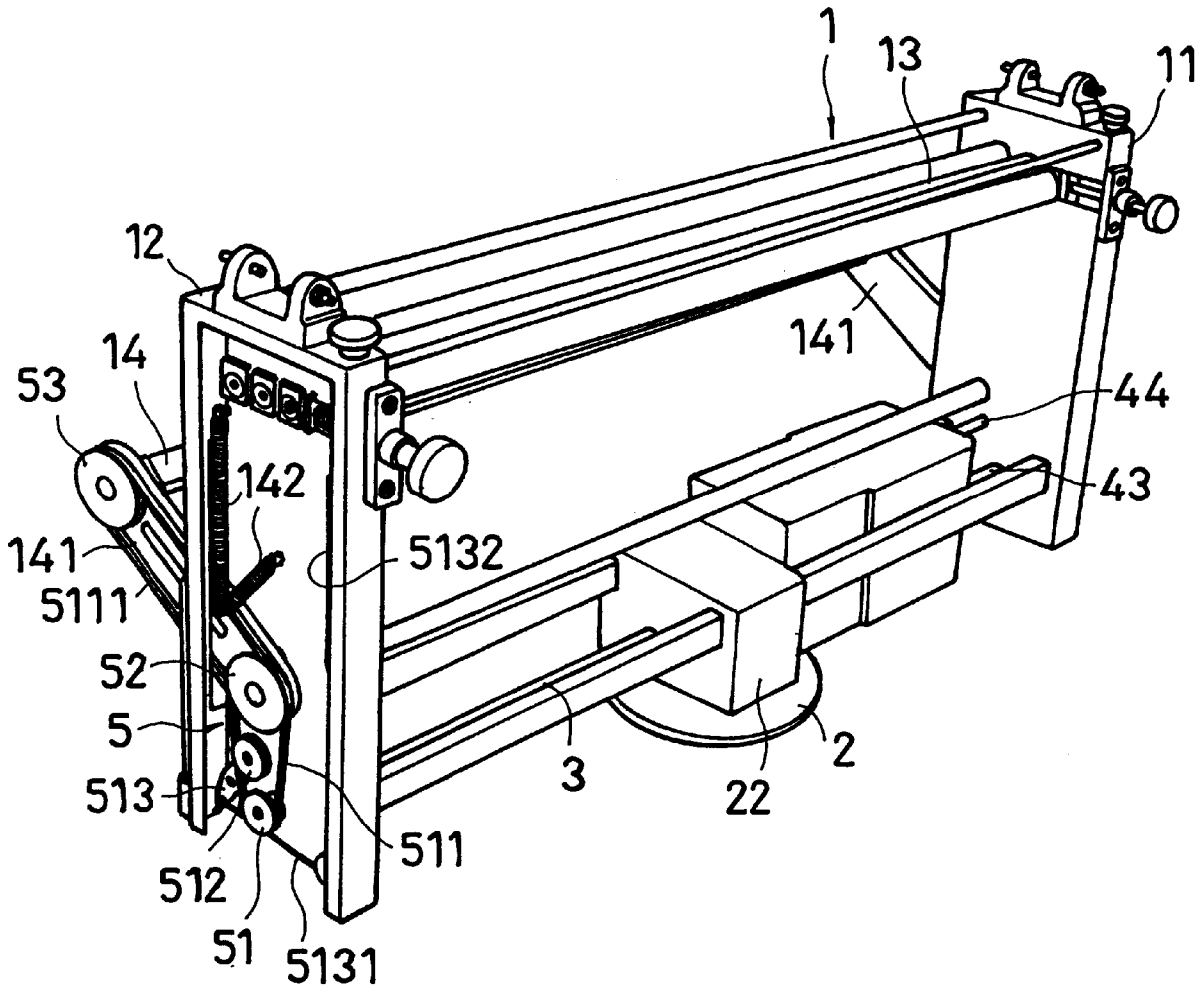
FIG. 1 is a perspective view of a cloth take-up device according to a first embodiment of the present invention.
Figure 2:
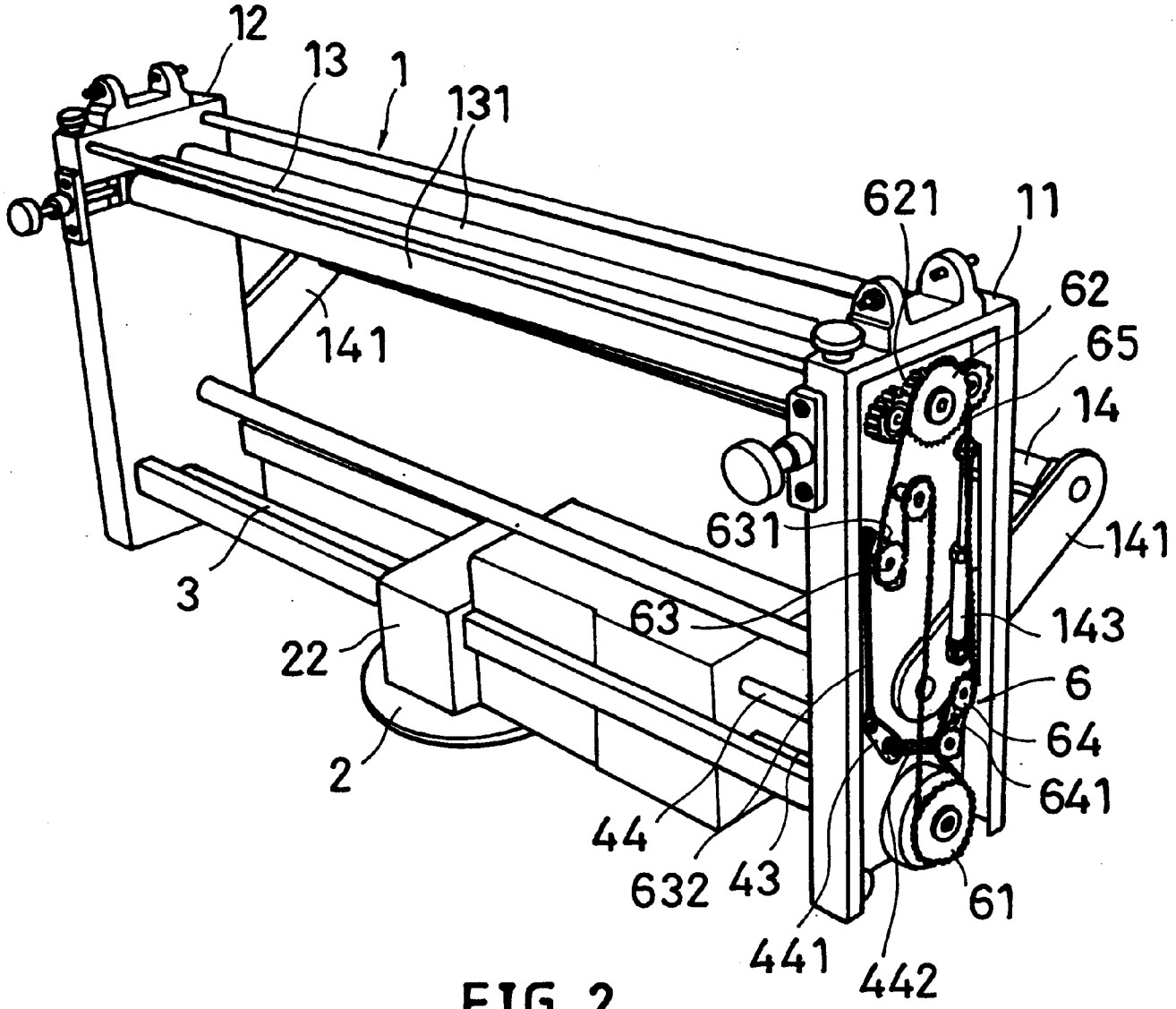
FIG. 2 is another perspective view of the cloth take-up device shown in FIG. 1 when viewed from another angle.
Figure 3:
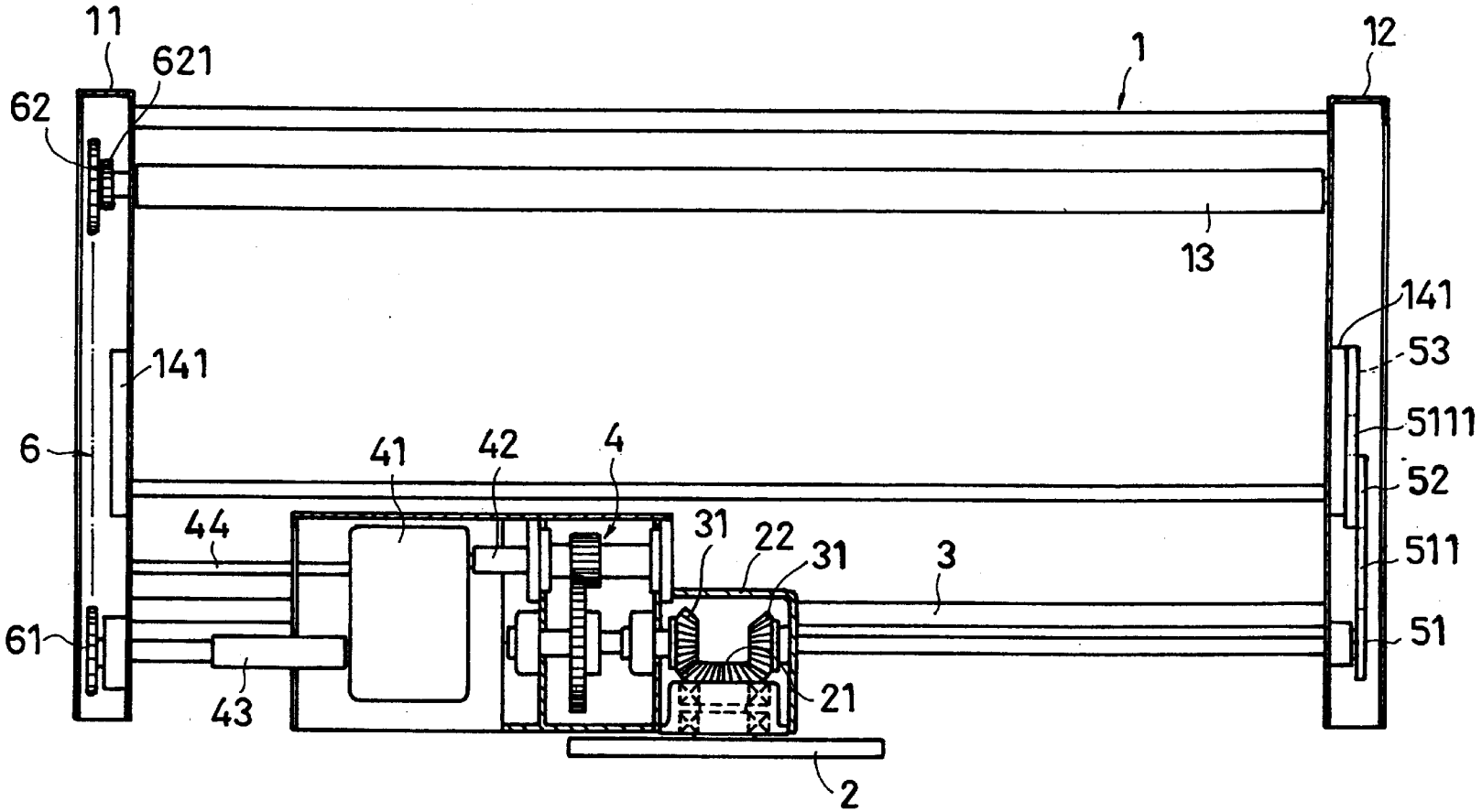
FIG. 3 is a front view in section of the cloth take-up device shown in FIG. 1.
Figure 4:
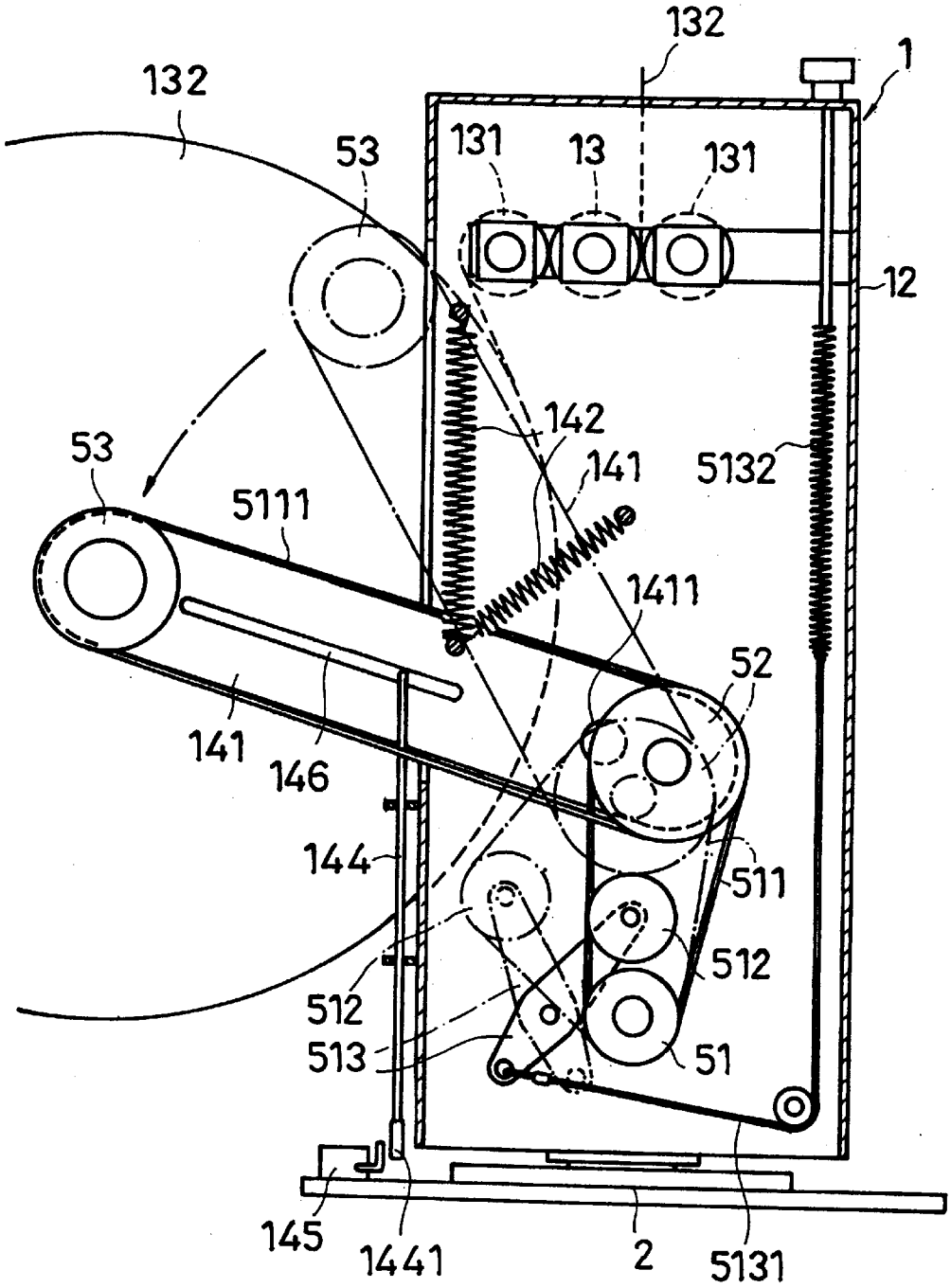
FIG. 4 is side view in section in an enlarged scale of the first embodiment of the present invention, showing the arrangement of the belt transmission mechanism.
Figure 5:
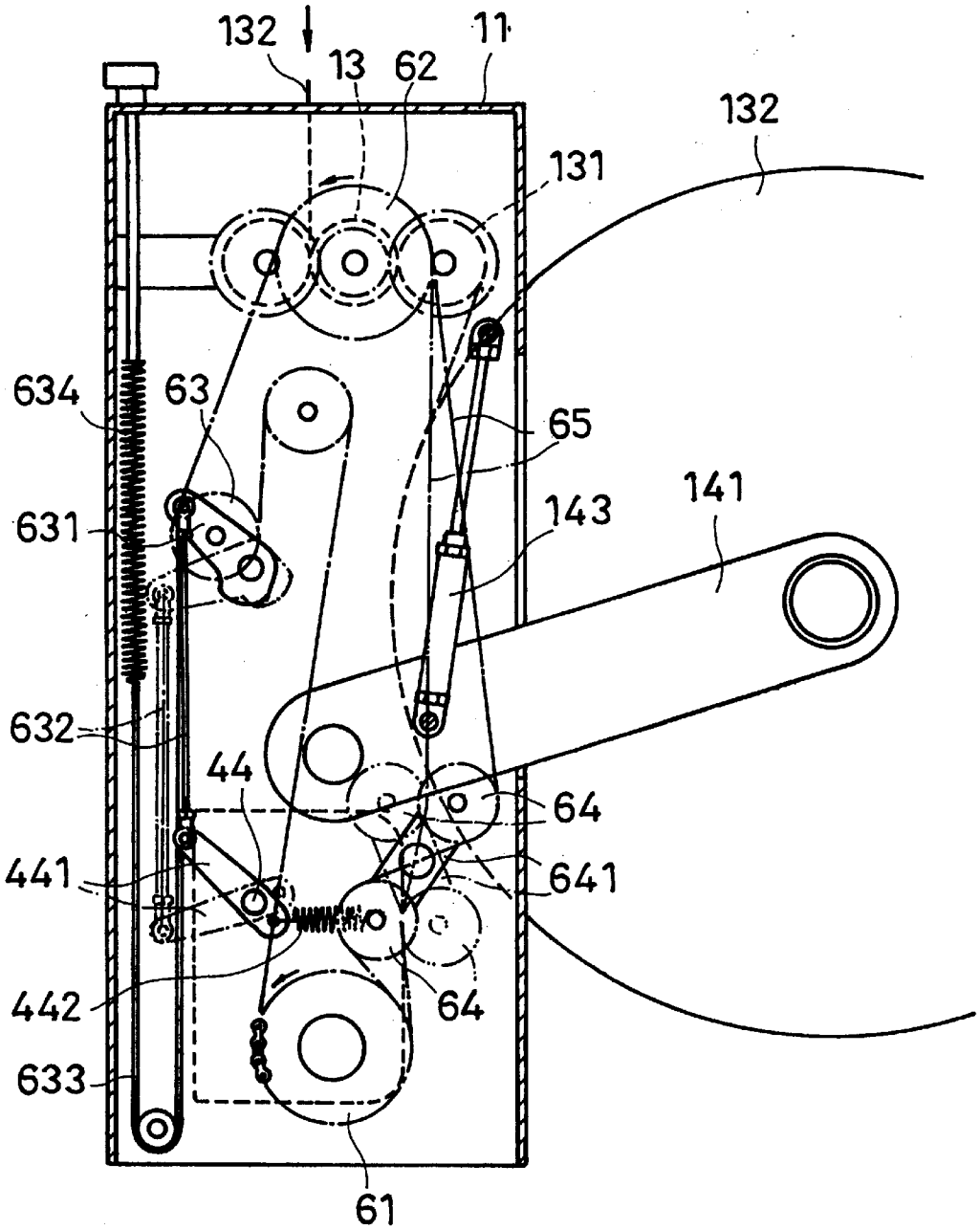
FIG. 5 is a side view in section in an enlarged scale of the first embodiment of the present invention, showing the arrangement of the chain transmission mechanism.

Referring to FIGS. from 1 to 5, a cloth take-up device 1 is shown comprising a bottom plate 2, two vertical side panels 11;12, a cloth-transfer cylinder 13 connected between the vertical side panels 11;12 at the top, two impression cylinders 131 connected in parallel between the vertical side panels 11;12 and peripherally disposed in contact with the cloth-transfer cylinder 13 at two opposite sides, a casing 22 provided at the bottom plate 2, two parallel support arms 141 respectively pivoted to the vertical side panels 11;12 by a respective pivot 1411, and a cloth take-up cylinder 14 connected between the support arms 141. A main bevel gear 21 is mounted inside the casing 22. A transmission shaft 3 is revolvably supported between the casing 22 and one vertical side panel 12 of the cloth take-up device 1. The transmission shaft 3 and a gear train 4 each have one end coupled to the main bevel gear 21 by a respective auxiliary bevel gear 31. The opposite end of the transmission shaft 3 is coupled to a belt transmission mechanism 5, which is driven to rotate the cloth take-up cylinder 14, causing it to take up finished knitted fabric 132. A stepless speed change device 41 is provided having an input shaft 42 coupled to the gear train 4, and an output shaft 43 coupled to a chain transmission mechanism 6, which is driven to rotate the cloth-transfer cylinder 13, enabling finished knitted fabric 132 to be carried into the cloth take-up device 1.

The belt transmission mechanism 5 is comprised of a driving wheel 51 turned with the transmission shaft 3, a driven wheel 53 fixedly mounted on one end-of the cloth take-up cylinder 14, an intermediate transmission wheel 52 revolvably supported on one support arm 141 at one end at an eccentric location relative to the pivoted center of the support arm 141, a first transmission belt 511 coupled between the driving wheel 51 and the intermediate transmission wheel 52, and a second transmission belt 5111 coupled between the intermediate transmission wheel 52 and the driven wheel 53. Springs 142 and a hydraulic cylinder 143 are respectively coupled between the vertical side panels 11;12 and the support arms 141 to buffer the lowering speed of the support arms 141 when the cloth take-up cylinder 14 takes up a certain amount of finished knitted fabric 132. A pressure wheel 512 is pivoted to a pressure arm 513, which is pivoted to one vertical side panel 12. A pull rope 5131 is provided having one end connected to a spring 5132 at one vertical side panel 12, and an opposite end connected to one end of the pressure arm 513. The pressure wheel 512 is peripherally retained in contact with the first transmission belt 511 to control its tension. When the support arms 141 are moved to a higher elevation (the cloth take-up cylinder 14 initially takes up finished knitted fabric 132 and bears less load), the intermediate transmission wheel 52 is moved to a lower elevation, and the pressure arm 513 is pulled by the spring 5132 through the pull rope 5131 to force the pressure wheel 512 against the first transmission belt 511, thereby causing the first transmission belt 511 to be stretched. A lift rod 144 is provided having a top end slidably coupled to a longitudinal sliding slot 146 on one support arm 141, and a bottom end terminating in a rubber strip 1441. When the support arms 141 are turned downwards to a certain extend, the lift rod 144 is forced to touch a micro switch 145, causing the cloth take-up device and the knitting machine to be shut off.

The chain transmission mechanism 6 comprises a driving chain wheel 61 coupled to the output shaft 43 of the stepless speed change device 41, a driven chain wheel 62 fixedly mounted on one end of the cloth-transfer cylinder 13, a chain 65 mounted on the driving chain wheel 61 and the driven chain wheel 62, a swivel pressure arm 641 rotatably supported on the vertical side panel 11, a spring 442 connected to one end of the swivel pressure arm 641 and imparting a pulling force to the swivel pressure arm 641, two pressure wheels 64 respectively mounted on two opposite ends of the pressure arm 641 and moved with the swivel pressure arm 641 to alternatively press on the chain 65 from both sides, an oscillating arm 631 pivoted to the vertical side panel 11, a tension detecting wheel 63 mounted on one end of the oscillating arm 631, a link 632 having one end pivoted to the oscillating arm 631 and an opposite end pivoted to a speed control shaft 44 of the stepless speed change device 41 through a crank 441, a pull rope 633 having one end connected to the oscillating arm 631 and an opposite end connected to a spring 634 at the vertical side panel 11. Normally, the chain 65 is pulled tight. When the feeding speed of the finished knitted fabric 132 drops, the revolution speed of the cloth-transfer cylinder 13 is slowed down. At this time, the chain 65 is stretched tight by the driving chain wheel 61, and the pressure wheels 64 are rotated, however the tension detecting wheel 63 is not immediately rotated. When the tension of the chain 65 is continuously increased, the tension detecting wheel 63 is then pulled to move upwards, causing the oscillating arm 631 to move the crank 441 in turning the speed control shaft 44, and therefore the revolution speed of the output shaft 43 of the stepless speed change device 41 is relatively adjusted. At the same time, the belt transmission mechanism 5 runs idle due to an overload, to prevent a damage to finished knitted fabric 132. When the feeding speed of finished knitted fabric 132 becomes normal, the pressure wheels 64 and the tension detecting wheel 63 are returned to their former positions, enabling the cloth take-up operation to be continued smoothly.

Figure 6:
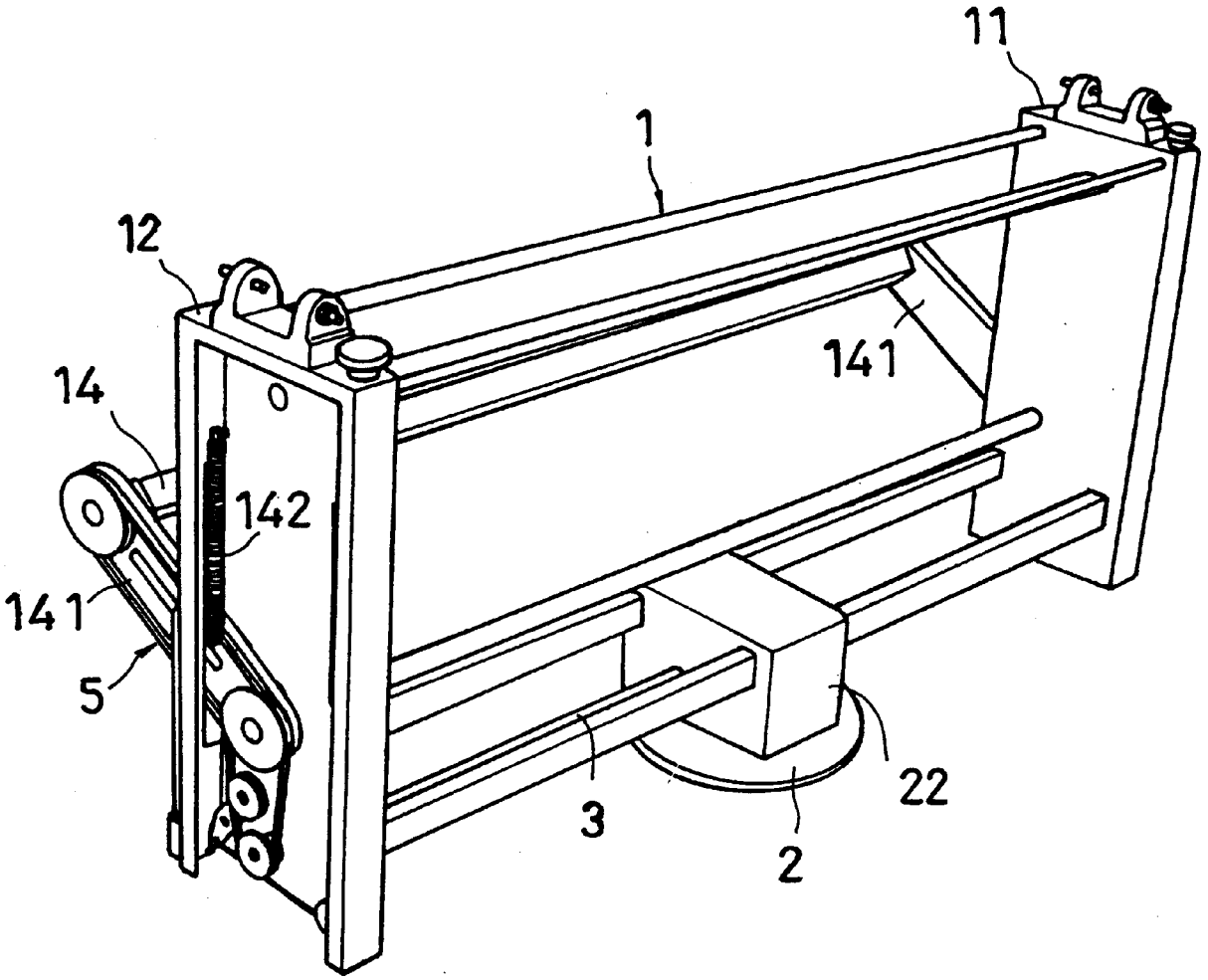
FIG. 6 is a perspective view of a cloth take-up device according to a second embodiment of the present invention.
Figure 7:
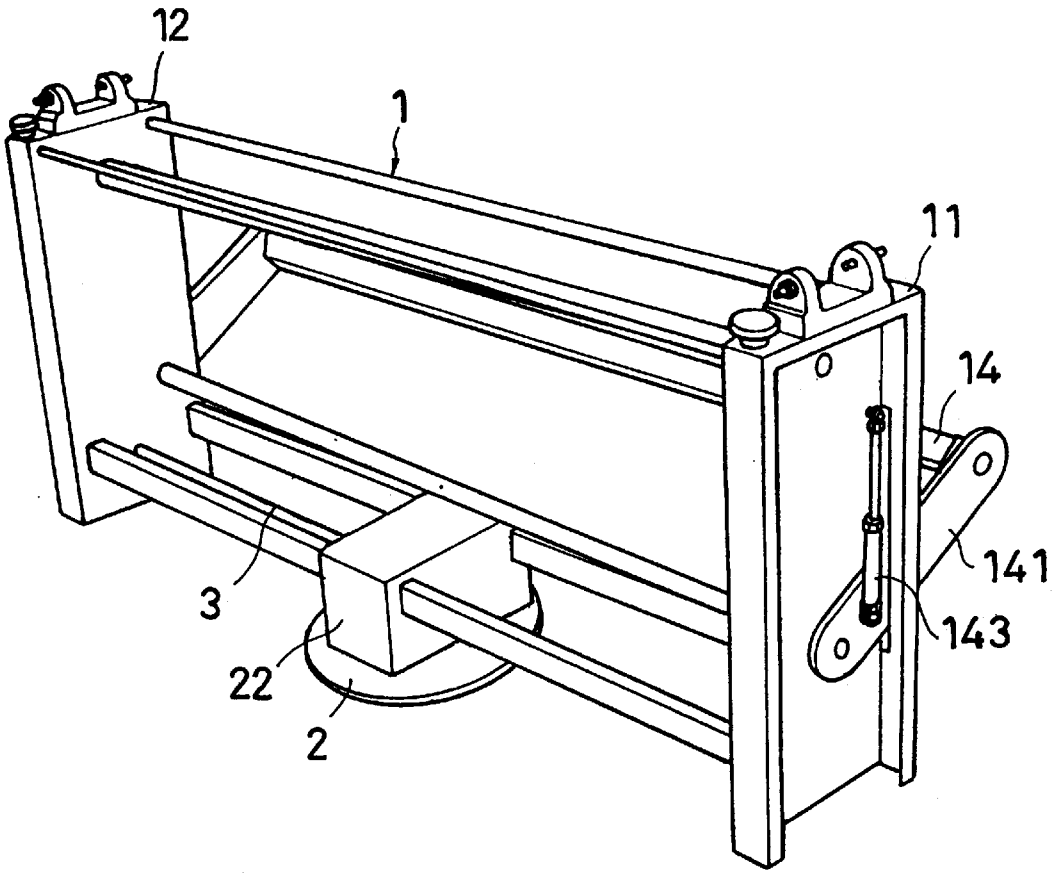
FIG. 7 is a perspective view of the cloth take-up device shown in FIG. 6 when viewed from another angle.

FIGS. 6 and 7 show an alternate form of the present invention, in which the transmission shaft 3 directly drives the belt transmission mechanism 5 to turn the cloth take-up cylinder 14 in taking up finished knitted fabric 132. This alternate form eliminates the aforesaid chain transmission mechanism 6 and stepless speed change device 41.

Figure 8:
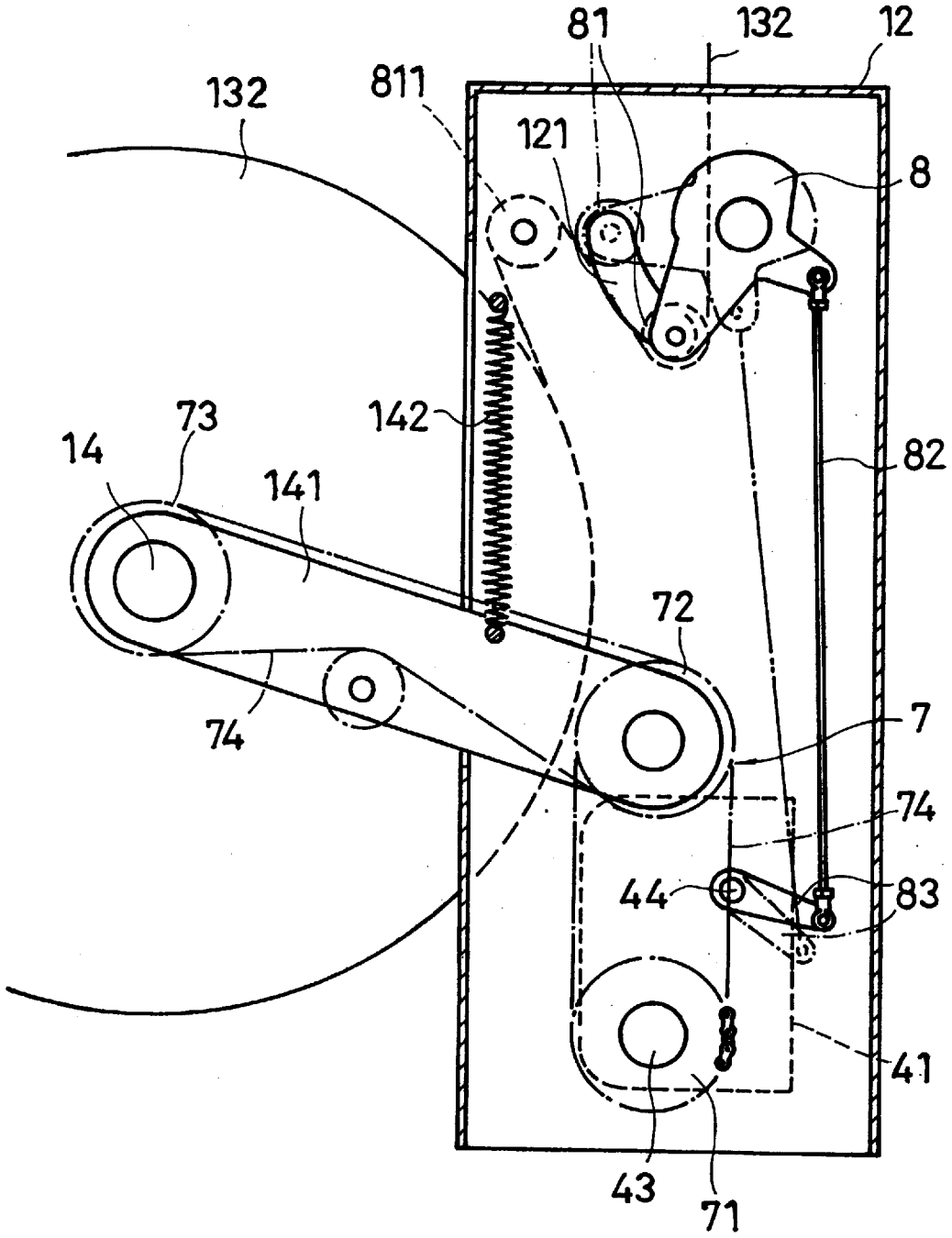
FIG. 8 is a left side view in section of a cloth take-up device according to a third embodiment of the present invention.
Figure 9:
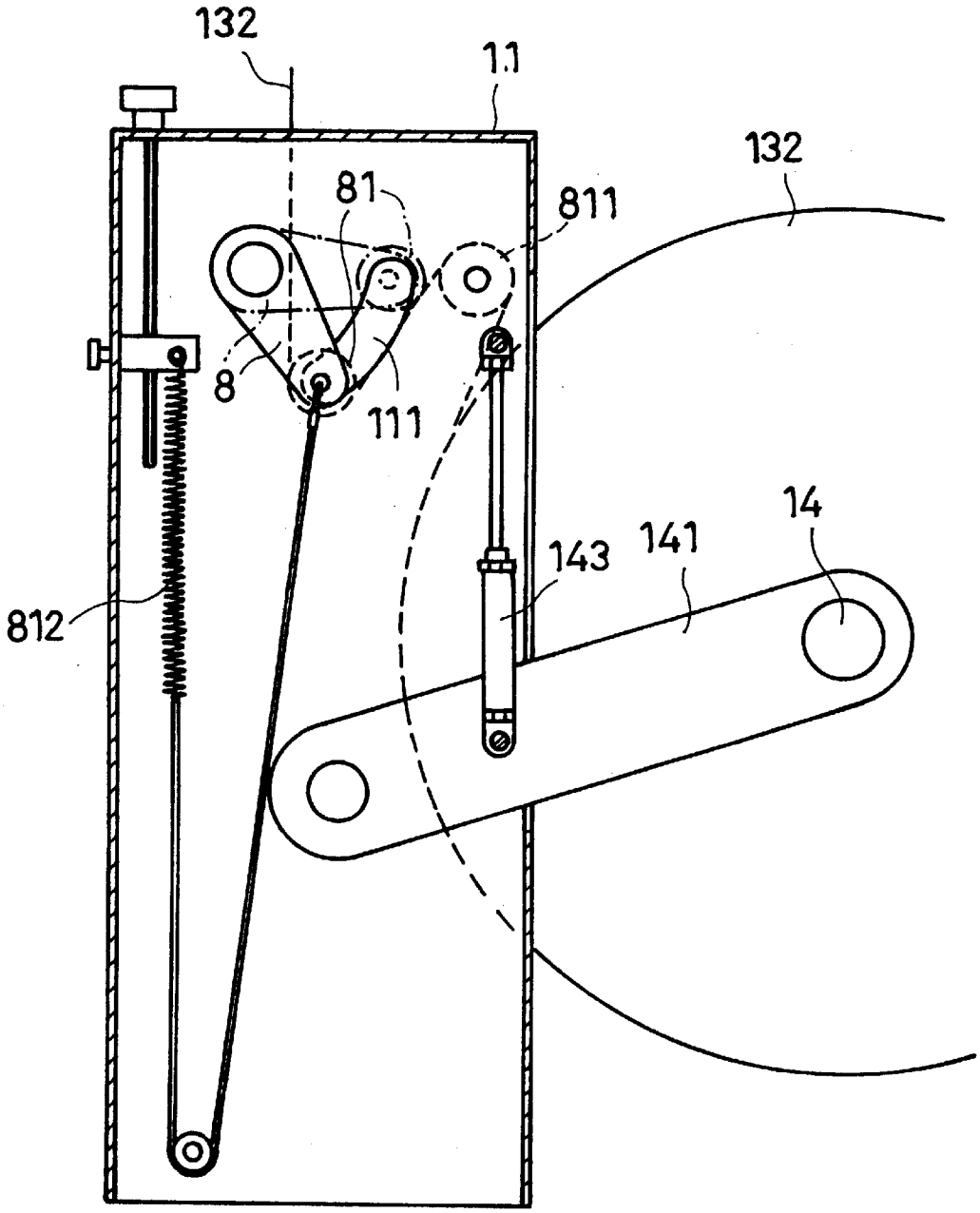
FIG. 9 is a right side view in section of the cloth take-up device shown in FIG. 8.

FIGS. 8 and 9 show another alternate form of the present invention. According to this alternate form, a stepless speed change device 41 is driven by a transmission shaft 3 through a gear train 4, enabling the output shaft 43 of the stepless speed change device 41 to turn a chain transmission mechanism 7, which is mounted on one vertical side panel 12. The chain transmission mechanism 7 comprises a driving chain wheel 71 mounted on the output shaft 43 of the stepless speed change device 41, a transmission chain wheel 72 mounted on one support arm 141 at one end, a driven chain wheel 73 mounted on one end of the cloth take-up cylinder 14, two chains 74 with one mounted on the driving chain wheel 71 and the transmission chain wheel 72 and the other mounted on the transmission chain wheel 72 and the driven chain wheel 73, two oscillating arms 8 respectively pivoted to the vertical side panels 11;12, a tension detecting cylinder 81 inserted through respective arched slots 111;112 on the vertical side panels 11;12 and connected between the oscillating arms 8, a cloth guide roller 811 for guiding finished knitted fabric 132 over the tension detecting cylinder 81, a link 82 having one end pivoted to one oscillating arm 8 and an opposite end pivoted to the speed control shaft 44 of the stepless speed change device 41 through a crank 83, and a spring 812 which imparts a pulling force to the other oscillating arm 8. When the feeding speed of finished knitted fabric 132 drops, the tension detecting cylinder 81 is pulled upwards, causing the oscillating arms 8 to lift the link 82. When the link 82 is lifted, the speed control shaft 44 is turned relatively, causing the stepless speed change device 41 to change the revolving speed of output shaft 43, and therefore the revolving speed of the driving chain wheel 71 is relatively reduced.

It is to be understood that the drawings are designed for purposes of illustration only, and are not intended as a definition of the limits and scope of the invention disclosed.

What the invention claimed is:

1. A cloth take-up device comprising:

a bottom plate;

a first vertical side panel and a second vertical side panel arranged in parallel;

a cloth-transfer cylinder connected between said vertical side panels adjacent a top side of said vertical side panels;

two impression cylinders connected in parallel between said vertical side panels and peripherally disposed in contact with said cloth-transfer cylinder at two opposite sides for guiding a finished piece of knitted fabric over said cloth-transfer cylinder;

a casing provided at said bottom plate;

two parallel support arms respectively pivoted to said vertical side panels;

a cloth take-up cylinder connected between said support arms;

a main bevel gear mounted inside said casing;

a transmission shaft revolvably supported between said casing and said second vertical side panel and coupled to said main bevel gear by a first bevel gear;

a gear train coupled to said main bevel gear by a second auxiliary bevel gear;

a belt transmission mechanism mounted on said second vertical side panel and driven by said transmission shaft to rotate said cloth take-up cylinder, causing it to take up the finished piece of knitted fabric;

a stepless speed change device having an input shaft coupled to said gear train, and an output shaft; and a chain transmission mechanism mounted on said first vertical side panel and driven by the output shaft of said stepless speed change device to rotate said cloth-transfer cylinder, enabling the finished piece of knitted fabric to be carried forwards by said cloth-transfer cylinder and taken up by said cloth take-up cylinder.

2. The cloth take-up device of claim 1 wherein said belt transmission mechanism is comprised of a driving wheel turned with said transmission shaft, a driven wheel fixedly mounted on one end of said cloth take-up cylinder, an intermediate transmission wheel revolvably supported on one of said support arms at one end at an eccentric location relative to the pivoted center of the respective support arm, a first transmission belt coupled between said driving wheel and said intermediate transmission wheel, a second transmission belt coupled between said intermediate transmission wheel and said driven wheel, a pair of first springs and a hydraulic cylinder respectively coupled between said vertical side panels and said support arms to buffer the lowering weed of said support arms when said cloth take-up cylinder takes up an amount of the finished piece of knitted fabric, a pressure arm pivoted to said second vertical side panel, a pressure wheel pivoted to said pressure arm, a pull rope having one end connected to a second spring at said second vertical side panel and an opposite end connected to one end of said pressure arm, said pressure wheel being peripherally retained in contact with said first transmission belt to control its tension, a lift rod having a top end slidably coupled to a longitudinal sliding slot on one of said support arms and a bottom end terminating in a rubber strip, said rubber strip being lowered with said lift rod to touch a micro switch when said support arms are turned downwards to a predetermined angle, causing said cloth take-up device to be shut off.

3. The cloth take-up device of claim 1 wherein said chain transmission mechanism comprises a driving chain wheel coupled to the output shaft of said stepless speed change device, a driven chain wheel fixedly mounted on one end of said cloth-transfer cylinder, a chain mounted on said driving chain wheel and said driven chain wheel, a swivel pressure arm rotatably supported on said first vertical side panel, a spring connected to one end of said swivel pressure arm and imparting a pulling force to said swivel pressure arm, two pressure wheels respectively mounted on two opposite ends of said pressure arm and moved with said swivel pressure arm to alternatively press on said chain from both sides, an oscillating arm pivoted to said first vertical side panel, a tension detecting wheel mounted on one end of said oscillating arm, a link having one end pivoted to said oscillating arm and an opposite end pivoted to a speed control shaft of said stepless speed change device through a crank, a pull rope having one end connected to said oscillating arm and an opposite end connected to a spring at said first vertical side panel.

4. A cloth take-up device comprising:

a bottom plate;

a first vertical side panel and a second vertical side panel arranged in parallel;

a cloth-transfer cylinder connected between said vertical side panels at a top side;

two impression cylinders connected in parallel between said vertical side panels and peripherally disposed in contact with the said cloth-transfer cylinder at two opposite sides for guiding a finished piece of knitted fabric over said cloth-transfer cylinder;

a casing provided at said bottom plate;

two parallel support arms respectively pivoted to said vertical side panels;

a cloth take-up cylinder connected between said support arms;

a main bevel gear mounted inside said casing;

a transmission shaft revolvably supported between said casing and said second vertical side panel and coupled to said main bevel gear by an auxiliary bevel gear; and a belt transmission mechanism mounted on said second vertical side panel and driven by said transmission shaft to rotate said cloth take-up cylinder, causing it to take up the finished piece of knitted fabric, said belt transmission mechanism comprising a driving wheel turned with said transmission shaft, a driven wheel fixedly mounted on one end of said cloth take-up cylinder, an intermediate transmission wheel revolvably supported on one of said support arms at one end at an eccentric location relative to the pivoted center of the respective support arm, a first transmission belt coupled between said driving wheel and said intermediate transmission wheel, a second transmission belt coupled between said intermediate transmission wheel and said driven wheel, springs a pair of first and a hydraulic cylinder respectively coupled between said vertical side panels and said support arms to buffer the lowering speed of said support arms when said cloth take-up cylinder takes up an amount of the finished piece of knitted fabric, a pressure arm pivoted to said second vertical side panel, a pressure wheel pivoted to said pressure arm, a pull rope having one end connected to a second spring at said second vertical side panel and an opposite end connected to one end of said pressure arm, said pressure wheel being peripherally retained in contact with said first transmission belt to control its tension, a lift rod having a top end slidably coupled to a longitudinal sliding slot on one of said support arms and a bottom end terminating in a rubber strip, said rubber strip being lowered with said lift rod to touch a micro switch when said support arms are turned downwards to a predetermined angle, causing said cloth take-up device to be shut off.

5. A cloth take-up device comprising:

a bottom plate;

a first vertical side panel and a second vertical side panel arranged in parallel;

a cloth-transfer cylinder connected between said vertical side panels at a top side;

two impression cylinders connected in parallel between said vertical side panels and peripherally disposed in contact with the said cloth-transfer cylinder at two opposite sides for guiding a finished piece of knitted fabric over said cloth-transfer cylinder;

a casing provided at said bottom plate;

two parallel support arms respectively pivoted to said vertical side panels;

a cloth take-up cylinder connected between said support arms;

a main bevel gear mounted inside said casing;

a transmission shaft revolvably supported between said casing and said second vertical side panel and coupled to said main bevel gear by an auxiliary bevel gear;

a gear train;

a stepless speed change device driven by said transmission shaft through said gear train, said stepless speed change device having an output shaft and a speed control shaft; and a chain transmission mechanism mounted on said second vertical side panel and coupled to the output shaft of said stepless speed change device to turn said cloth take-up cylinder, said chain transmission mechanism comprising a driving chain wheel mounted on the output shaft of said stepless speed change device, a transmission chain wheel mounted on one of said support arms at one end, a driven chain wheel mounted on one end of said cloth take-up cylinder, two chains with one mounted on said driving chain wheel and said transmission chain wheel and the other mounted on said transmission chain wheel and said driven chain wheel, two oscillating arms respectively pivoted to said first and second vertical side panels, a tension detecting cylinder inserted through respective arched slots on said first and second vertical side panels and connected between said oscillating arms, a cloth guide roller for guiding the finished piece of knitted fabric over said tension detecting cylinder, a link having one end pivoted to one of said oscillating arms and an opposite end pivoted to said speed control shaft of said stepless speed change device through a crank, and a spring which imparts a pulling force to the other oscillating arm said tension detecting cylinder being pulled upwards when the feeding speed of the finished piece of knitted fabric drops, causing said oscillating arms to lift said link, said speed control shaft of said stepless speed change device being turned when said link is lifted, causing said stepless speed change device to change the revolving speed of said output shaft and said driving chain wheel.

* * * * *